US007320614B2

(12) United States Patent
Toda et al.

(10) Patent No.: US 7,320,614 B2
(45) Date of Patent: Jan. 22, 2008

(54) FEMALE CONNECTOR AND MALE CONNECTOR

(75) Inventors: Kenichi Toda, Kanagawa (JP); Hong Fan Shin, Singapore (SG)

(73) Assignees: J.S.T. Mfg. Co., Ltd., Osaka-shi (JP); MEA Technologies Pte. Ltd., Singapore (SG)

( * ) Notice: Subject to any disclaimer, the term of this patent is extended or adjusted under 35 U.S.C. 154(b) by 0 days.

(21) Appl. No.: 11/606,770

(22) Filed: Nov. 29, 2006

(65) Prior Publication Data

US 2007/0141888 A1 Jun. 21, 2007

(30) Foreign Application Priority Data

Nov. 29, 2005 (SG) ..... 200507716-9

(51) Int. Cl.
*H01R 13/64* (2006.01)

(52) U.S. Cl. ..... 439/358; 439/607; 439/700; 439/217; 439/327; 439/287

(58) Field of Classification Search ..... 439/358, 439/607, 214, 327, 387, 700
See application file for complete search history.

(56) References Cited

U.S. PATENT DOCUMENTS 5,762,520 A * 6/1998 Martin ..... 439/470
5,823,828 A * 10/1998 Bricaud et al. ..... 439/630
6,095,868 A * 8/2000 Hyland et al. ..... 439/630
6,648,694 B2 * 11/2003 Takamori et al. ..... 439/630

FOREIGN PATENT DOCUMENTS

JP 5-6722 1/1993
JP UM-A-5-6722 1/1993

OTHER PUBLICATIONS

Patent Abstracts of Japan; Publication No. 5-6722 dated Jan. 14, 1993 (2 pages).

* cited by examiner

*Primary Examiner*—Truc Nguyen
(74) *Attorney, Agent, or Firm*—Osha Liang LLP

(57) ABSTRACT

An apparatus is disclosed including a female and a male connector wherein the female connector has a resin first connector body to which a first set of contact pins are attached and a tubular metallic shell that ensheathes the outer surfaces of the first connector body. In front of the first tubular body, two pairs of opposing overhangs are formed projecting a certain distance from the forward surface of the first connector body, whereby one pair of overhangs is bent mid-way in a direction such that their forward edges approach each other but a certain gap is provided between them forming first and second guide latching portions. One of the other pair of opposing overhangs has an insertion opening formed in it, into which the male connector is inserted and passes through the aforementioned gap in order to affect connection while being guided by the first and second guide latching portions.

9 Claims, 7 Drawing Sheets

PRIOR ART

FEMALE CONNECTOR AND MALE CONNECTOR

BACKGROUND OF THE INVENTION

The present invention relates to a female connector and a male connector and more particularly to a female connector and a male connector that can be connected by insertion either horizontally or vertically.

Connectors are used for electrically connecting various component elements. Normally they come in pairs which are connected by insertion end-to-end from opposite directions. The conventional type of pair of connectors is such that the second connector is laterally inserted into the first connector.

FIG. 7 is a perspective view of the connector disclosed in Japanese Utility Model JP-UM-A-5-6722, which is composed of a first connector 31 and a second connector 33, structured in such manner that a square U-shaped latching part 32 is provided around the periphery of the front end surface of the first connector 31 and a brim part 34 around the periphery of the front end surface of the second connector 33, whereby the brim part 34 of the second connector 33 fits into the square U-shaped latching part 32 of the first connector 31.

Such first and second connectors 31 and 33 are connected by lateral insertion and therefore suited to situations where space constraints preclude direct end-to-end connection (serial connection). In this mode of connection, where the brim part 34 of the second connector 33 fits into the latching part 32 of the first connector 31, however, the connectors cannot be disconnected in a direction perpendicular to the direction of insertion.

Despite having the characteristic features described above, the first and second connectors disclosed in JP-UM-A-5-6722 are not grounded when they are joined together via their housings, because the housings are made of synthetic resin, which has insulating properties. One way of effecting ground connection is to utilize the contact pins for signals/power supply that are attached to the housings as grounding pins. This method however results in fewer contact pins for signals/power supply, or requires extra contact pins, which would entail extra space to accommodate the connector, which may be large in size. Another disadvantage of using this method is that shielding the connectors described above against electromagnetic waves is not possible, considering that such electromagnetic shielding is essential in order to make the connectors capable of high-speed transmission and similar applications. A further difficulty is posed by the first and second connectors being joined together by the fitting of the brim part of the second connector into the latching part of the first connector as this would require the joining of two resin housings, which gives rise to the problem of maintaining the high mechanical strength of the joint portion.

SUMMARY OF THE INVENTION

The present invention was made in order to resolve such longstanding technical problems by providing a female connector and a male connector that do not require grounding contact pins and can be connected as a pair by insertion horizontally or a vertically, and whose joining is effected via metallic shells in order to enhance the mechanical strength of the joint portion.

To achieve the aforementioned purpose, the female connector according to claim 1 of the present invention is equipped with a first connector body made of resin to which a first set of contact pins is attached and a first metallic shell for ensheathing the first connector body, and has the following innovative features:

the first metallic shell has a tubular body that ensheathes the outer surfaces of the first connector body, while four overhangs are formed at the front of the first metallic tubular shell in such manner as to project a certain distance from the forward surface of the first connector body, the first and second overhangs of the first to fourth overhangs being made to reside opposite each other and bent mid-way in the direction such that their forward edges approach each other but a certain gap is provided between them, thus forming first and second guide latching portions, and the third and fourth overhangs being positioned opposite each other with either one having an insertion opening formed in it, and the male connector is inserted into such insertion opening while being guided by the first and second guide latching parts as it passes through the aforementioned gap in order to effect connection.

The invention according to claim 2 is the female connector according to claim 1, with the further innovative feature that an indentation is formed on the edge of the overhang in which the insertion opening is formed to expose the side wall of the connector body.

The invention according to claim 3 is the female connector according to claim 1, with the further innovative feature that the inner portion of the insertion opening of the first metallic shell is blocked by an overhang.

The invention according to claim 4 is the female connector according to claim 1, with the further innovative feature that in at least one of the overhangs in which the first and second guide latching parts are provided, a latching protrusion for restricting movement toward the insertion opening is formed.

The invention according to claim 5 is a male connector that combines with the female connector according to any of claims 1 to 4. This male connector is equipped with the following innovative features:

a second metallic tubular shell having a pair of first and second thin grooves residing on its outer surface to be inserted through the insertion opening of the female connector and are engaged by the first and second guide latching parts; and a second connector body that is ensheathed in the second metallic shell and has a second set of contact pins attached to it that contact with the first set of contact pins.

The invention according to claim 6 is the male connector according to claim 5, with the further innovative feature that a thin groove is provided with a latching part to engage with the latching protrusion formed in one or both of the overhangs in which the first and second guide latching parts are provided in the female connector for the purpose of restricting movement toward the insertion opening.

Owing to the structure described above, the present invention yields the following highly beneficial effects. Namely, in the present invention the male connector and the female connector are joined together by joining their respective metallic shells, and specifically by joining the pair of first and second guide latching parts formed from the overhangs of the female metallic shell of the female connector with the metallic shell of the male connector, as a result of which the joint portion is structured to have robust mechanical strength. Further, such joining via their metallic shells serves to ground the connectors, rendering them suitable for use as high-speed transmission connectors. Moreover, since the insertion opening can be formed either vertically or horizontally, the connectors may be used even in environments where there is limited or no space for serial connection.

It will also be possible to form an indentation on the edge of an overhang of the female connector that exposes the side wall of the connector body, so as to eliminate contacting of the contact pins of the male connector with the metallic shall overhangs of the female connector when the male connector is inserted, thereby preventing the occurrence of damage to or wearing out of the contact pins.

Further, an overhang can be used to block off the inner portion of the insertion opening of the female connector. In that case, when the male connector is inserted it will strike the blocking overhang and hence will not spring out on the opposite side of the insertion. In this way the male connector will be firmly positioned and secured, with the result that the contact pins of the two connectors will contact correctly.

Moreover, a latching protrusion for restricting movement of the male connector toward the insertion opening could be formed in the female connector while a latching part can be formed on the thin groove of the male connector. In that case, such latching part of the male connector will engage with the latching protrusion of the female connector when the two connectors are joined together, thereby firmly positioning and securing the connectors so that their joining will be stable. The latching protrusion also provides audible click sound and insertion feeling as male connector being inserted to the targeted position.

BRIEF DESCRIPTION OF THE DRAWINGS

The invention will be described with reference to the accompanying drawings, wherein like numbers refer to like elements.

DESCRIPTION OF THE PREFERRED EMBODIMENT

The best mode embodiments of the present invention will be described hereafter with reference to the drawings. However, the embodiments illustrated below merely represent illustrative examples of a female connector and male connector for realizing the technical concept of the present invention and are not intended to limit the present invention since adaptations can be made to produce other equally valid embodiments without departing from the scope of the claims.

Embodiment 1

Figure 1:
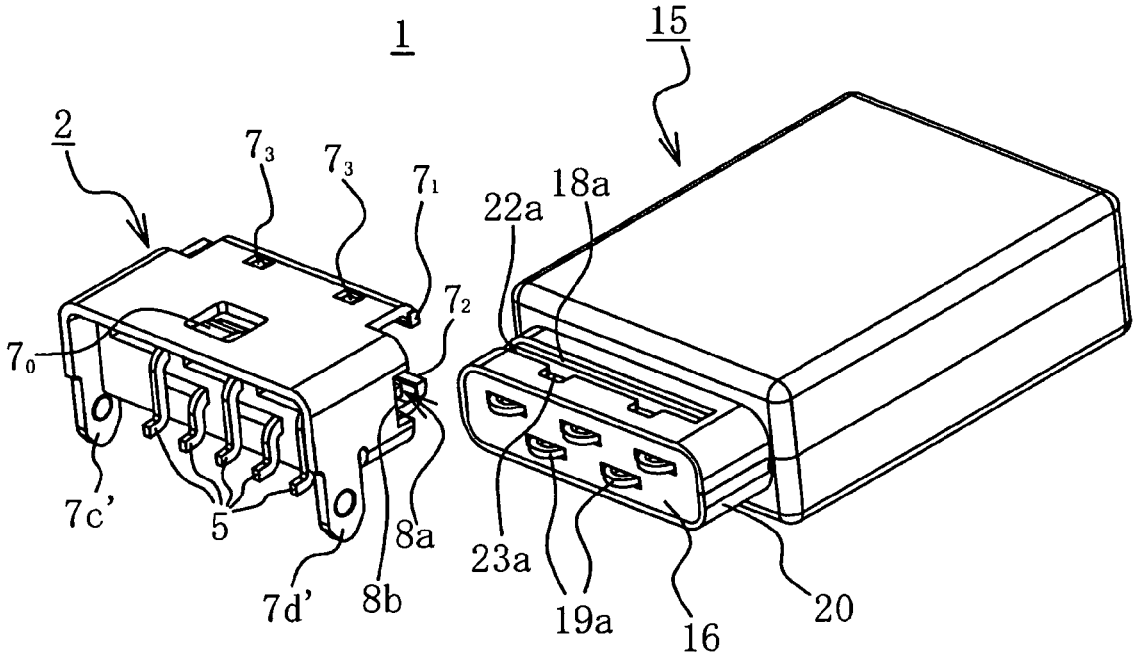
FIG. 1 is a perspective view of the female connector and male connector according to the first embodiment of the present invention, prior to being joined together.
Figure 2:
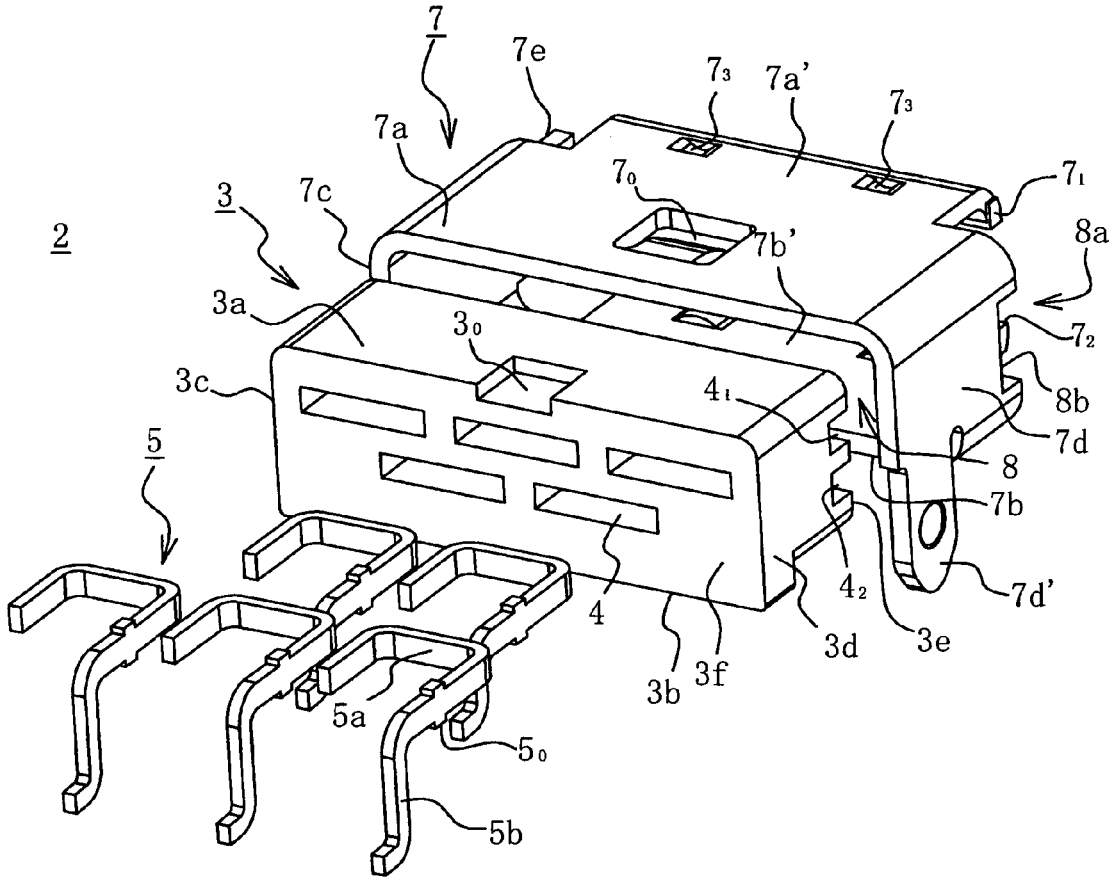
FIG. 2 is an exploded perspective view of the female connector.
Figure 3:
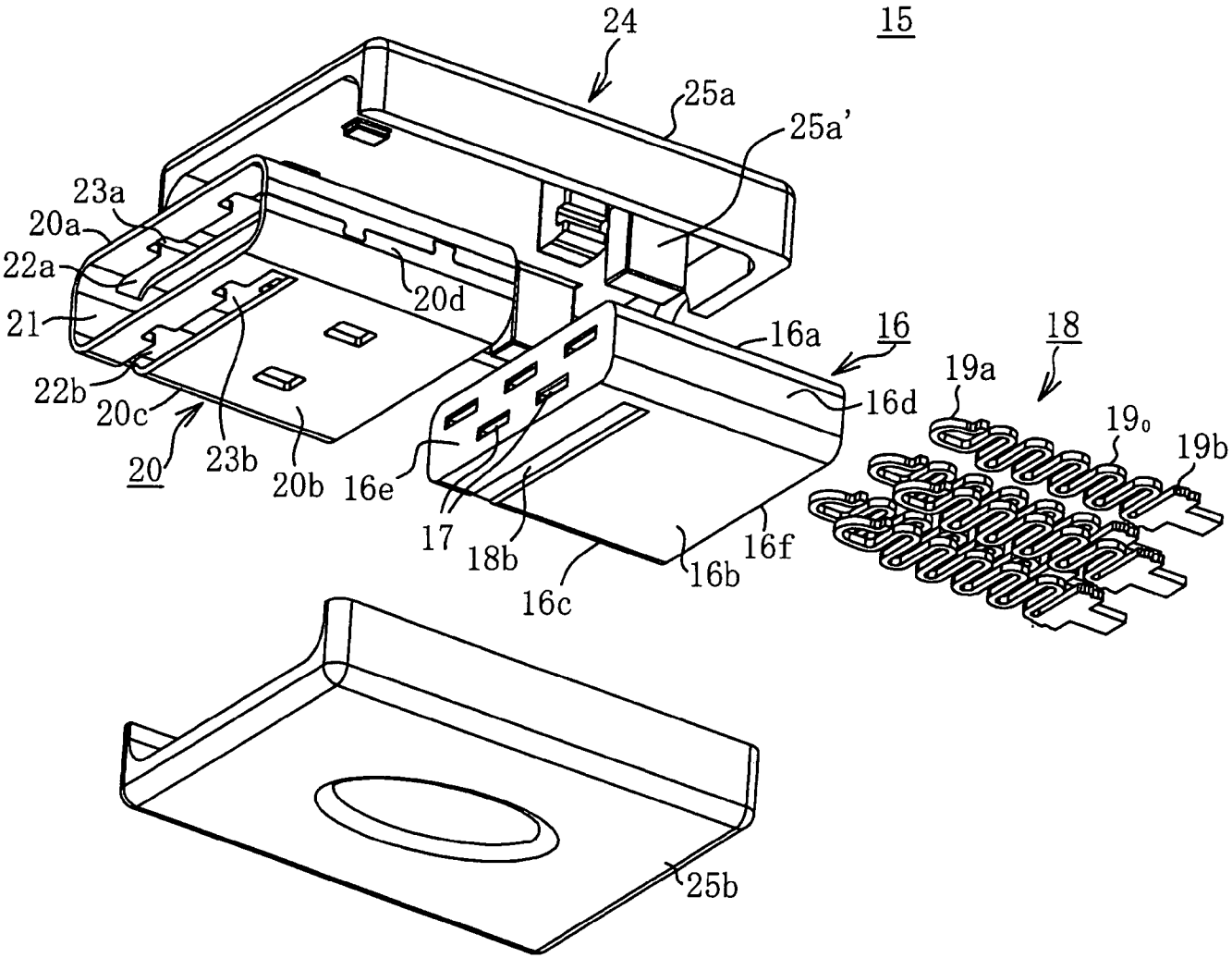
FIG. 3 is an exploded perspective view of the male connector.
Figure 4:
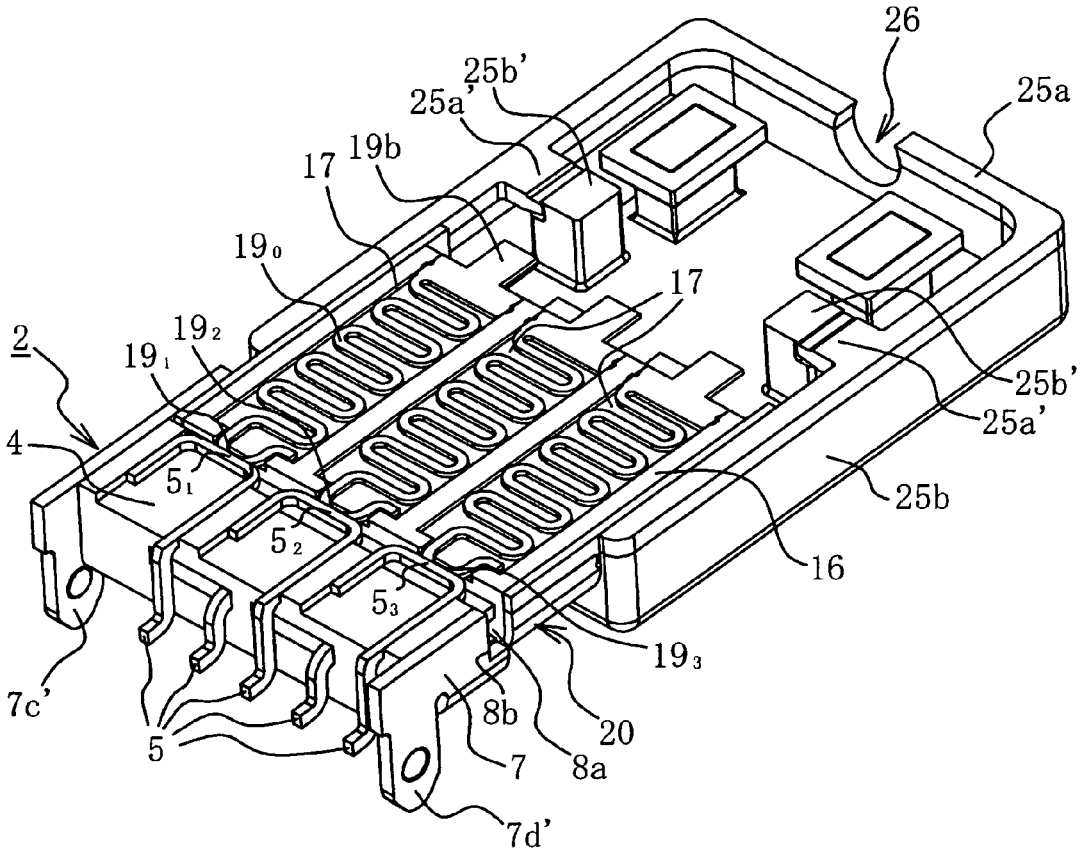
FIG. 4 is a horizontal cross-sectional view of the female and male connectors according to the first embodiment of the present invention in the joined state.

FIG. 1 is a perspective view of the female connector and male connector of the first embodiment of the present invention prior to being joined together, FIG. 2 is an exploded perspective view of the female connector, FIG. 3 is an exploded perspective view of the male connector, and FIG. 4 is a horizontal cross-sectional view of the female connector and male connector in the joined state.

As shown in FIG. 1, the pair of connectors 1 of this embodiment consists of a female connector 2 and a male connector 15 that is connected by being slid into the female connector 2 horizontally either from the left or right side.

The female connector 2 is attached to a printed circuit board or similar item. As shown in FIG. 2, it has a plurality of contact pins 5, a synthetic resin connector body 3 that has through-holes 4 into which the contact pins 5 are fitted, and a metal shell 7 that ensheathes the top and sides of the connector body 3.

The connector body 3 takes the form of a flattened cuboid that has top and bottom walls 3*a*, 3*b*, side walls 3*c*, 3*d*, and front and back walls 3*e*, 3*f*, with a plurality of through-holes 4 formed on it, extending from the back wall 3*f* toward the front wall 3*e*, into which the contact pins 5 described later are inserted. These through-holes 4 have rectangular openings matching the outer dimensions of the contact pins 5 and are formed in two rows, one upper and one lower. In the front wall 3*e*, two parallel square-bottomed grooves $\mathbf{4}_1$, $\mathbf{4}_2$ are formed in the longitudinal direction in such manner that the contacting part 5*a* of the contact pins 5 will be positioned inside the contact pins. A relatively broad, square-bottomed latching slot $\mathbf{3}_0$ is formed at roughly the central point on the rear edge of the top wall 3*a*. In addition, latching portions (omitted from the drawing) into which the latching protrusions $\mathbf{5}_0$ of the contact pins 5 latch onto are formed inside the through-holes 4.

The contact pins 5 have a contacting part 5*a* that is bent into a U-shape, and a terminal part 5*b* that first extends rearward from the contacting part 5*a* then drops downward to be connected to a circuit board by soldering or other means, and a latching protrusion $\mathbf{5}_0$ is provided between these two parts. The pins are formed from a metallic material with good electrical conductivity.

When the contact pins 5 having the structure described above are fitted into the through-holes 4 of the connector body 3, their U-shaped contacting portions 5*a* project towards the square-bottomed grooves $\mathbf{4}_1$, $\mathbf{4}_2$ in the front wall 3*e*.

The metallic shell 7, as shown in FIG. 2, is formed to have an elongated flattened tubular shape having through-holes 8 into which the connector body 3 is inserted. Specifically, it is formed by bending-processing a metal sheet of a certain size so as to have top and bottom walls 7*a*, 7*b* and side walls 7*c*, 7*d* that match the shape of the connector body 3. Roughly at the center of the top wall 7*a*, a latching tongue $\mathbf{7}_0$ which latches into the latching slot $\mathbf{3}_0$ in the connector body 3 is formed. Terminal strips 7*c*', 7*d*' that protrude downward are formed on the side walls 7*c* and 7*d*. Terminal strip 7*c*' is obscured by the connector body 3 in FIG. 2. These terminal strips 7*c*', 7*d*' will, for example, be inserted into mounting holes in a circuit board (not shown) and connected to a conductor on the circuit board by soldering or other means.

The ends of the top and bottom walls 7*a*, 7*b* and left side wall 7*c* of the metallic shell 7 are made to project forward to form overhangs 7*a*', 7*b*' and 7*e*, with the top and bottom overhangs 7*a*', 7*b*' of these overhangs 7*a*' to 7*e* being bent inwardly mid-way so as to form a pair of guide latching parts $7_1$, $7_2$. These guide latching parts $7_1$, $7_2$ are deployed with a certain gap between them so that the end portion thereof is not closed. The male connector 15 described later is to be inserted into this gap. Further, each of the top and bottom overhangs 7*a*', 7*b*' have a pair of appropriately spaced latching protrusions $7_3$, $7_3$ formed on them that protrude inwardly. The lower latching protrusions $7_3$, $7_3$, of the bottom overhang 7*b*' are obscured in FIG. 2. These protrusions are engaged with the square-bottomed grooves of the male connector 15, which is described later.

An insertion opening 8*a* is formed on the right side wall 7*d* of the metallic shell 7. This insertion opening 8*a* is formed between the end portion of the right side wall 7*d* and the pair of guide latching parts $7_1$, $7_2$, the corresponding inward space from the insertion opening 8*a* being a cavity for insertion of the male connector. At the end of the edge of the right side wall 7*d* adjacent to the insertion opening 8*a* a cut-out 8*b* is formed to have a size as would expose the square-bottomed grooves $4_1$, $4_2$ on the front wall of the connector body 3 when the latter is inserted. Because of the presence of the square-bottomed grooves $4_1$, $4_2$, the contacting parts 19*a* of the male connector 15's contact pins 18 will not in any manner strike against the end portion of the metallic right side wall 7*d* when the male connector 15 is inserted into the insertion opening 8*a*. Accordingly, the grooves prevent the infliction of damage and wear and tear that may be occasioned by such striking. In addition, the overhang 7*e* that projects from the left side wall 7*c* extends so as to block off the cavity, thereby serving as a retainer that prevents the male connector 15 from emerging on the side opposite the insertion opening 8*a*.

The male connector 5 that is joined to the female connector 2 shall be described next with reference to FIG. 3.

As shown in FIG. 3, the male connector 15 has a plurality of contact pins 18, a synthetic resin connector body 16 with through-holes into which the contact pins 18 are fitted, a metal shell 20 with a through-holes 21 into which the connector body 16 is inserted, and a cover 24 that ensheathes the metal shell 20.

The connector body 16 takes the form of a flattened cuboid that has top and bottom walls 16*a*, 16*b*, side walls 16*c*, 16*d*, and front and back walls 16*e*, 16*f*, and has a plurality of through-holes 17 formed in it, extending from the front wall 16*e* toward the back wall 16*f*, into which the contact pins are inserted. The length and width of these through-holes 17 match the outer dimensions of the contact pins 18 and are so formed that when the contact pins 18 are inserted into the through-holes 17, the contacting parts 19*a* of the contact pins 18 will be positioned so as to protrude from the front wall 16*e* (refer to FIG. 4).

In the front portions of the top and bottom walls 16*a*, 16*b*, straight, square-bottomed thin grooves 18*a*, 18*b* extending widthwise are formed, that is, in the direction orthogonal to the longitudinal direction, from one side wall 16*c* toward a certain distance before the other side wall 16*d*. The guide latching parts $7_1$, $7_2$ of the female connector 2 will mate with these thin grooves 18*a*, 18*b*.

The contact pins 18 have a contacting part 19*a* whose tip is curved into a circular arc, a terminal part 19*b* that extends rearward from the contacting part 19*a*, and, between these two parts, a connecting part $19_0$ that is bent into the shape of a spring and joins them to form an integrated whole. The pins are formed from metal with good electrical conductivity. The presence of the connecting part $19_0$ imparts a certain contact pressure to the contacting part 19*a*.

The metallic shell 20 has good conductivity, and is formed to have an elongated flattened tubular shape having longitudinal through-holes 21 into which the connector body 16 is inserted. Specifically, the metal shell 20 is formed by bend-processing a metal sheet of a certain size so as to have top and bottom walls 20*a*, 20*b* and side walls 20*c*, 20*d* that match the shape of the connector body 16. On the top and bottom walls 20*a*, 20*b*, a plurality of latching holes is formed.

Also, slits 22*a*, 22*b* that have roughly the same length and width as those of the thin grooves 18*a*, 18*b* in the connector body 16 are formed on the top and bottom walls 20*a*, 20*b*, in positions corresponding to the thin grooves 18*a*, 18*b*, and extend from the side wall 20*c* toward a certain distance before the other side wall 20*d*., Two square-bottomed grooves 23*a*, 23*b*, into which the latching protrusions $7_3$, $7_3$ of the female connector 2 engage, are formed in each of the slits 22*a*, 22*b*, respectively.

The cover 24 is composed of a pair of flat housings 25*a*, 25*b* formed from synthetic resin that cover the top and bottom walls 20*a*, 20*b* and side walls 20*c*, 20*d* of the metallic shell 20. In each of the housings 25*a*, 25*b* joining bars 25*a*', 25*b*' in the vicinity of their side walls are formed. At the rear of the cover 24, a hole 26 is formed through which cables that are connected to the contact pins pass through (refer to FIG. 4).

To assemble the male connector 15, first the contact pins 18 are inserted into the through-holes 17 in the connector body 16, effecting positioning and fastening. Next, the connector body 16 with the contact pins 18 fitted into it is inserted into the through-holes 21 and secured to the metal shell 20. Then the cover 24 is placed over the outer surface of the metal shell 20 in such a way that the front end of the shell is left exposed, or more specifically the slits 22*a*, 22*b* remain exposed and are positioned in front of the cover 24 (refer to FIG. 1).

The two connectors 2, 15 are connected together by inserting the assembled male connector 15 into the insertion opening 8*a*. To effect such insertion, the guide latching portions $7_1$, $7_2$ of the female connector 2 are mated to the slits 22*a*, 22*b* of the male connector 15 respectively and the contacting parts 19*a* of the contact pins 18 are mated to the square-bottomed grooves $4_1$, $4_2$, after which the male connector 15 is slid into the cavity of the female connector 2. Such sliding operation brings the contact pins 18 of the male connector 15 into contact with the contact pins 5 of the female connector 2.

As will be seen from FIG. 4, such contacting proceeds as follows. The contacting part $19_1$ of the contact pin 18 located on the left side of the male connector 15 first makes contact with the contacting part $5_3$ of the contact pin 5 located on the right side of the female connector 2, then makes contact with the contacting part $5_2$ of the contact pin 5 centrally located in the female connector 2, and subsequently comes to rest in contact with the contacting part $5_1$ of the contact pin 5 located on the left side of the female connector 2. When the contacting part $19_1$ of the contact pin 18 makes contact with contacting parts $5_3$ and $5_2$, the contacting part $19_1$ is moved toward the terminal portion by the spring force of the connecting part $19_0$ of the contact 19, while retracting at the same time, until finally it comes into elastic contact with its corresponding contacting parts $5_1$, $19_1$. Concurrently, the contacting parts $19_2$ and $19_3$ of the other contact pins 18 of the male connector 15 are likewise brought into elastic contact with their corresponding contacting parts $5_2$ and $5_3$ of the contact pins 5, respectively. Upon the joining of the male connector 15 and the female connector 2, the latching protrusions $7_3$, $7_3$ of the female connector 2 engage with the square bottomed grooves 23*a*, 23*b* in the male connector 15. In FIG. 4, the plurality of contacting parts 5*a* of the contact pins 5 of the female connector 2 are represented by reference numerals $5_1$ to $5_3$, and the contacting parts 19*a* of the plurality of contact pins 18 of the male connector 15 are indicated by reference numerals $19_1$ to $19_3$, for ease of understanding.

In the connector 1 described above, the insertion opening 8*a* is formed on the right side wall 7*d* of the metal shell 7, but it could equally well be formed on the opposite wall, the left side wall 7*c*. If the insertion opening 8*a* is formed on the left side wall 7*c*, an overhang 7*e* will be formed that blocks off the cavity on the right side wall 7*d*.

Embodiment 2

Figure 5:
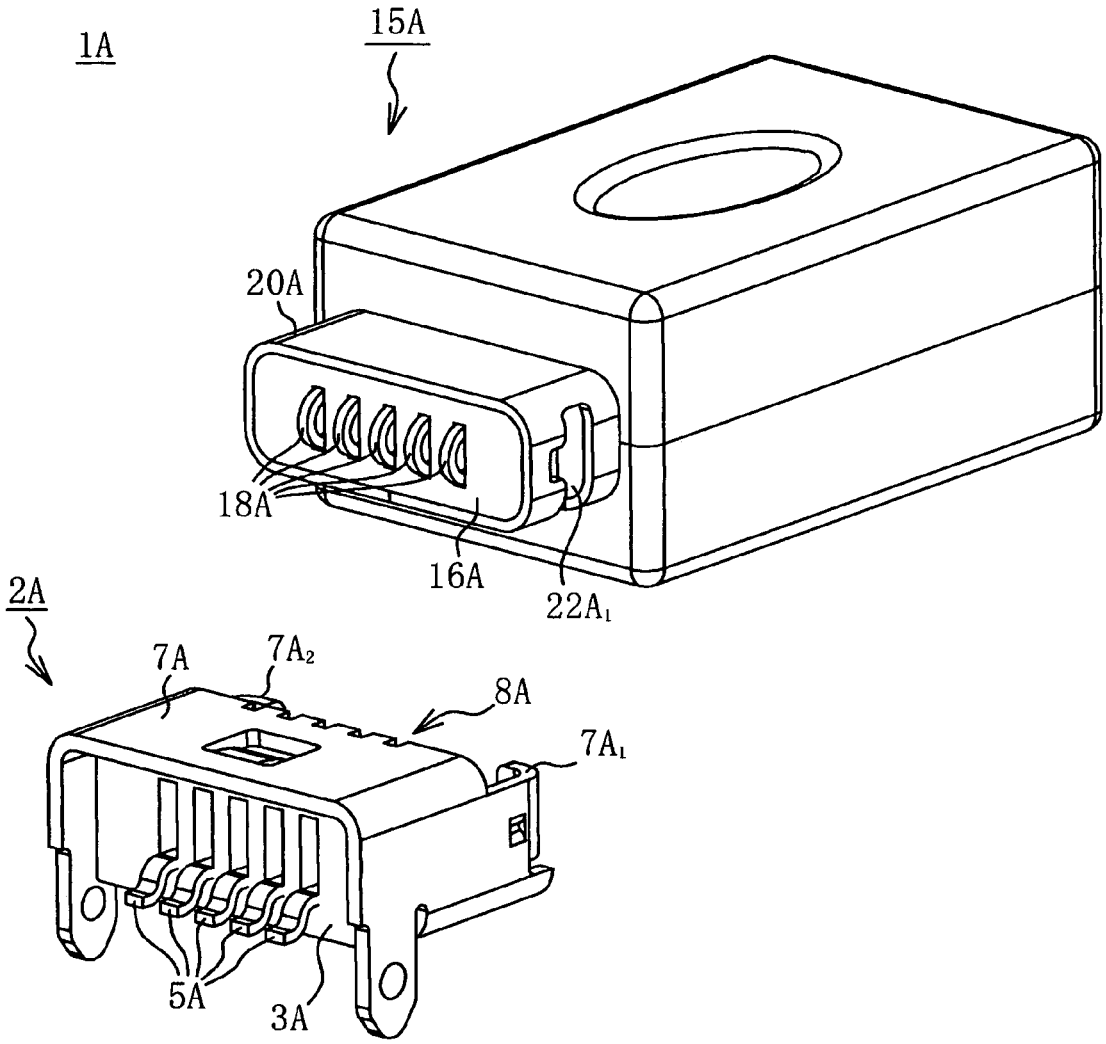
FIG. 5 is a perspective view of the female connector and male connector according to the second embodiment of the present invention, prior to being joined together.
Figure 6:
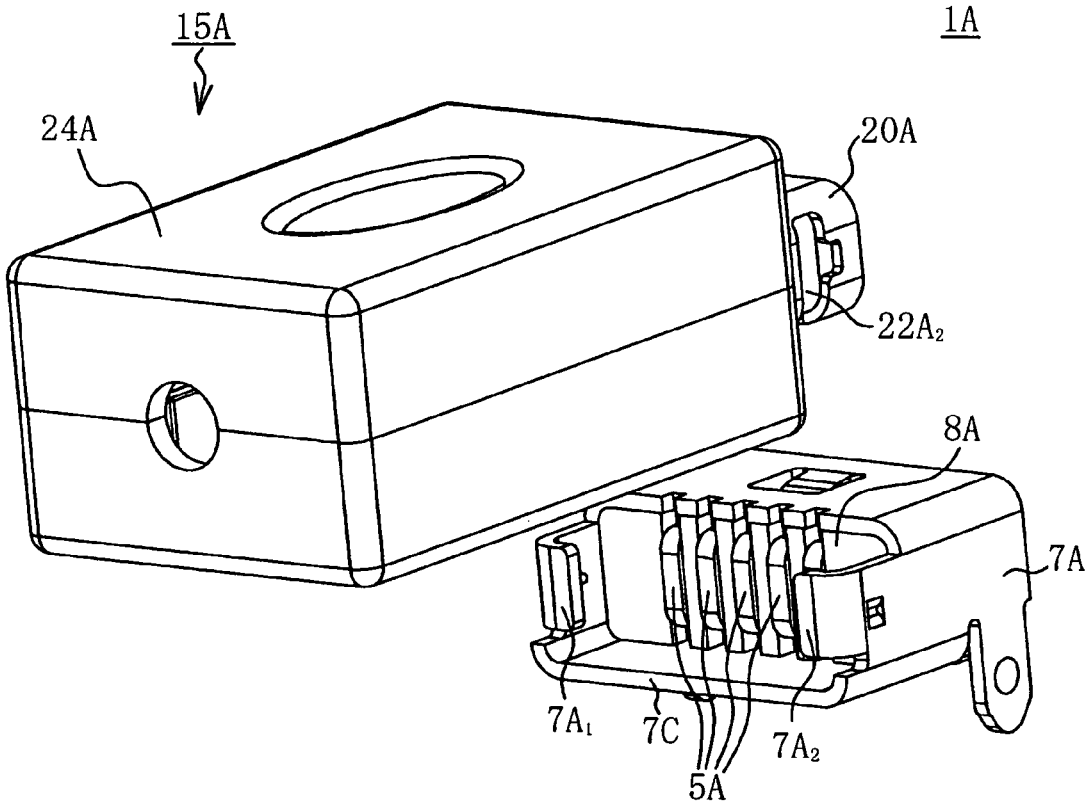
FIG. 6 is a perspective view of the female and male connectors in FIG. 5 from a different direction.
Figure 7:
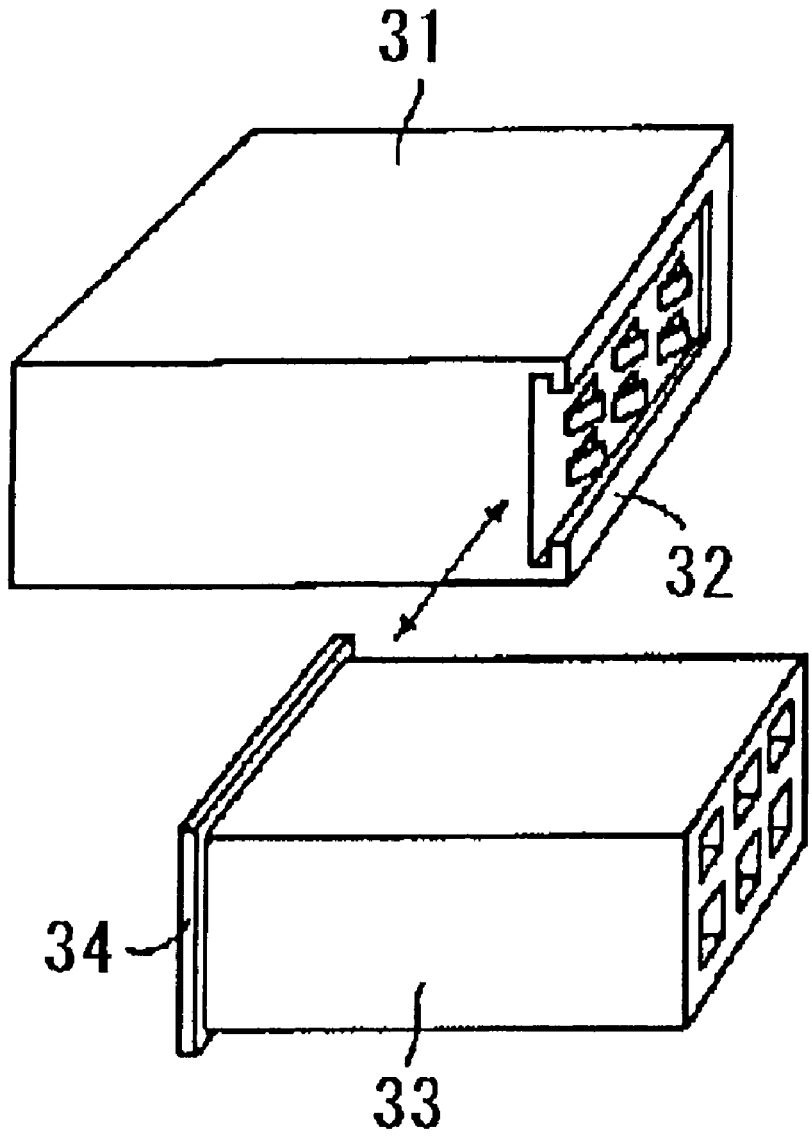
FIG. 7 is a perspective view of a connector of a conventional type.

FIGS. 5 and 6 show the female connector and male connector of the second embodiment of the present invention, FIG. 5 is a perspective view of the female and male connectors prior to being joined together, while FIG. 6 is another perspective view of the female and male connectors in FIG. 5 from a different direction. Whereas the insertion opening of the connector 1 in Embodiment 1 described above is formed on either the left or the right side wall of the female connector, the insertion opening of the connector 1A of Embodiment 2 is provided on either the top or bottom wall thereof so as to permit connection by insertion in a vertical manner.

More specifically, as shown in FIGS. 5 and 6, the connector 1A is composed of a female connector 2A and a male connector 15A that is slid into the female connector 2A vertically either from above (as shown in the example) or from below so as to effect connection by insertion. The female connector 2A has a metal shell 7A and a connector body 3A equipped with contact pins 5A. In the metal shell 7A guide latching parts $7A_1$, $7A_2$ and an insertion opening 8A are provided at the ends of the side walls. The male connector 15A has a cover 24A, a metal shell 20A, and a connector body 16A equipped with contact pins 18A. On the sides of the metal shell 20A a pair of slits $22A_1$, $22A_2$ are formed with which the guide latching portions $7A_1$, $7A_2$ mate. Reference numeral 7C indicates a metal overhang which serves as a retainer to inhibit the male connector 15A from being disengaged from the bottom when it is inserted into insertion opening 8*a* on top of the female connector 2A.

The joining of connector 1A differs from that of connector 1 in Embodiment 1 only as regards the direction of connection. Therefore a description of its connection method has been omitted. The insertion opening 8A may also be provided either at the top or at the bottom of the connector 1A.

As may be understood from the foregoing embodiments, it is possible to install the female connector and male connector of the present invention even in environments with limited or no installation space, by employing items with the appropriate lateral or vertical connection direction to match the form of the installation location in particular.

What is claimed is:

1. A female connector comprising:

a first connector body made of resin to which a first set of contact pins is attached; and a first metallic tubular shell that ensheathes the outer surfaces of the first connector body;

wherein first to fourth overhangs are formed at the front of the first metallic tubular shell in such manner as to project a certain distance from the forward surface of the first connector body, whereby the first and second overhangs of four overhangs reside opposite each other and bent mid-way in the direction such that their forward edges approach each other but a certain gap is provided between them, thus forming first and second guide latching portions, and the third and fourth overhangs being positioned opposite each other with either one having an insertion opening formed in it into which a male connector is inserted and guided by the first and second guide latching parts as it passes through the aforementioned gap in order to effect connection.

2. The female connector according to claim 1, wherein an indentation that exposes the side wall of the said connector body is formed on the edge of the overhang in which the said insertion opening is formed.

3. The female connector according to claim 1, wherein the inner portion of the insertion opening of the metallic shell is blocked off by the overhang.

4. The female connector according to claim 1, wherein a latching protrusion for restricting movement toward the insertion opening is formed in at least one of the four overhangs in which the first and second guide latching parts are provided.

5. A male connector that combines with the female connector according claim 1, comprising:

a second metallic tubular shell having a pair of thin grooves in its outer surface that are inserted into the insertion opening of the said female connector's and are engaged by the first and second guide latching parts; and a second connector body that is ensheathed in the second metallic shell and has a second set of contact pins attached to it that contact with the first set of contact pins.

6. A male connector that combines with the female connector according to claim 2, comprising:

a second metallic tubular shell having a pair of thin grooves in its outer surface that are inserted into the insertion opening of the said female connector's and are engaged by the first and second guide latching parts; and a second connector body that is ensheathed in the second metallic shell and has a second set of contact pins attached to it that contact with the first set of contact pins.

7. A male connector that combines with the female connector according to claim 3, comprising:

a second metallic tubular shell having a pair of thin grooves in its outer surface that are inserted into the insertion opening of the said female connector's and are engaged by the first and second guide latching parts; and a second connector body that is ensheathed in the second metallic shell and has a second set of contact pins attached to it that contact with the first set of contact pins.

8. A male connector that combines with the female connector according to claim 4, comprising:

a second metallic tubular shell having a pair of thin grooves in its outer surface that are inserted into the insertion opening of the said female connector's and are engaged by the first and second guide latching parts; and a second connector body that is ensheathed in the second metallic shell and has a second set of contact pins attached to it that contact with the first set of contact pins.

9. The male connector according to claim 8, wherein a thin groove(s) is provided with a latching part to engage with the latching protrusion(s) for the purpose of restricting movement toward the insertion opening, and formed in one or both of the overhangs in which the first and second guide latching parts are provided in the female connector.

* * * * *